US008012655B2

(12) United States Patent
De Jong et al.

(10) Patent No.: US 8,012,655 B2
(45) Date of Patent: Sep. 6, 2011

(54) IMAGING MEMBER AND METHODS OF FORMING THE SAME

(75) Inventors: Kathy L. De Jong, London (CA); Nan-Xing Hu, Oakville (CA); Yvan Gagnon, Mississauga (CA); Yu Qi, Oakville (CA); Ah-Mee Hor, Mississauga (CA); Cuong Vong, Hamilton (CA); Vladislav Skorokhod, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 684 days.

(21) Appl. No.: 12/107,549

(22) Filed: Apr. 22, 2008

(65) Prior Publication Data

US 2009/0263737 A1 Oct. 22, 2009

(51) Int. Cl.
*G03G 5/047* (2006.01)

(52) U.S. Cl. ..... 430/58.8; 430/59.4; 430/59.6; 430/66; 399/159

(58) Field of Classification Search ..... 430/59.6, 430/58.05, 58.8, 66
See application file for complete search history.

(56) References Cited

U.S. PATENT DOCUMENTS

| | | | | |
|---|---|---|---|---|
| 3,121,006 | A | 2/1964 | Middleton et al. | |
| 4,355,124 | A * | 10/1982 | Baumann et al. | 524/104 |
| 5,096,795 | A * | 3/1992 | Yu | 430/58.8 |
| 5,709,950 | A * | 1/1998 | Burgman et al. | 428/423.1 |
| 5,733,698 | A * | 3/1998 | Lehman et al. | 430/66 |
| 6,071,660 | A | 6/2000 | Black et al. | |
| 6,197,463 | B1 | 3/2001 | Cais et al. | |
| 6,242,144 | B1 * | 6/2001 | Lin et al. | 430/58.4 |
| 6,800,411 | B2 * | 10/2004 | Tong et al. | 430/58.05 |
| 6,913,863 | B2 * | 7/2005 | Wu et al. | 430/58.8 |
| 2004/0185358 | A1 | 9/2004 | Kami | |
| 2007/0072101 | A1 * | 3/2007 | Dinh et al. | 430/66 |
| 2007/0298340 | A1 | 12/2007 | Mishra et al. | |
| 2008/0063962 | A1 | 3/2008 | Toshine et al. | |
| 2008/0227008 | A1 * | 9/2008 | Kami et al. | 430/66 |

OTHER PUBLICATIONS

Diamond, A.S., ed., Handbook of Imaging Materials, Marcel Dekker, Inc., NY (1991), pp. 383-384 and 395-396.*
Diamond, A.S., et al. ed., Handbook of Imaging Materials, Second Edition, Marcel Dekker, Inc., NY (2002), pp. 174-175.*
International Search Report dated Jul. 29, 2009 for European Patent Application No. 09153116.0, 7 pages.

* cited by examiner

*Primary Examiner* — Janis L Dote
(74) *Attorney, Agent, or Firm* — Pillsbury Winthrop Shaw Pittman LLP

(57) ABSTRACT

The presently disclosed embodiments are directed to an imaging member having an outermost layer formulation that includes wax particles which creates a rough surface morphology for the layer and imparts increased scratch resistance, reduced torque, and improved cleaning performance to the layer. In embodiments, the outermost layer is an overcoat layer used for an improved imaging member having a substrate, a charge transport layer, and an overcoat positioned on the charge transport layer.

17 Claims, 1 Drawing Sheet

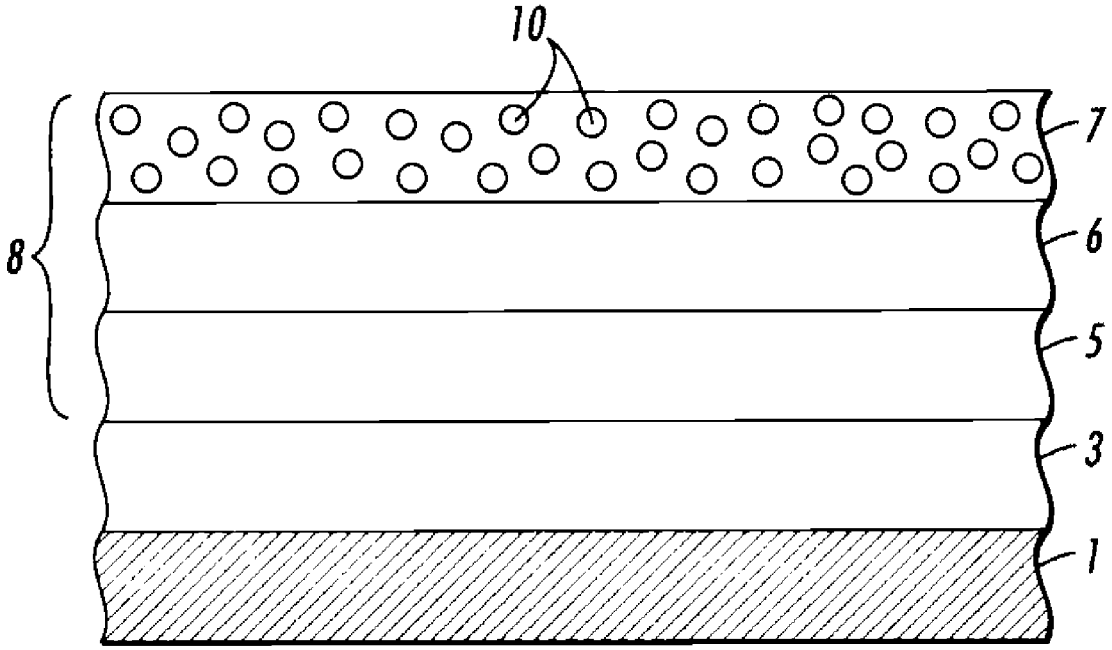
10
7
6
5
3
1
8

IMAGING MEMBER AND METHODS OF FORMING THE SAME

BACKGROUND

The presently disclosed embodiments relate generally to layers that are useful in imaging apparatus members and components, for use in electrostatographic, including digital, apparatuses. More particularly, the embodiments pertain to an improved imaging member having an outermost layer that has a rough surface morphology which provides improved performance. In embodiments, the outermost layer is an overcoat layer having an overcoat formulation including wax particles which creates the rough surface morphology evenly across the surface of the photoreceptor to form an improved overcoat layer.

Electrophotographic imaging members, e.g., photoreceptors, photoconductors, imaging members, and the like, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors or imaging members have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoat layer and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

In conventional photoreceptors, mechanical wear due to cleaning blade contact or scratches due to contact with paper or carrier beads causes photoreceptor devices to fail. Thus, it is desired that formulations used to form the outermost layer of these photoreceptors be formulated to increase mechanical wear and scratch resistance.

SUMMARY

According to aspects illustrated herein, there is provided an electrostatographic imaging member comprising a substrate, and an imaging layer disposed on the substrate, wherein an outermost layer of the electrostatographic imaging member further comprises a polymer matrix, a charge transport component and a plurality of wax particles, such that the outermost layer acquires a rough surface morphology.

A further embodiment provides an electrostatographic imaging member comprising a substrate, an imaging layer disposed on the substrate, wherein the imaging layer comprises a charge generation layer disposed on the substrate, and a charge transport layer disposed on the charge generation layer, and an overcoat layer disposed on the charge transport layer, wherein the overcoat layer comprises a cured composite composition comprised of polymer resin, a charge transport component and a plurality of wax particles, such that the overcoat layer acquires a rough surface morphology.

In yet another embodiment, there is provided an electrophotographic imaging apparatus comprising at least one photosensitive member, a charging unit, a developing unit, and a transfer unit, wherein the photosensitive member includes an overcoat layer having a rough surface morphology comprising a cured composite coating, the coating further comprising a plurality of wax particles, a melamine resin and tertiary arylamine transport component containing a substituent selected from the group consisting of a hydroxyl, a hydroxymethyl, and an alkoxymethyl having from about 2 to about 6 carbons, and the photosensitive member is rigid or flexible

BRIEF DESCRIPTION OF THE DRAWINGS

For a better understanding, reference may be had to the accompanying FIGURE.

The FIGURE is a cross-sectional view of an imaging member having an overcoat layer according to the present embodiments.

DETAILED DESCRIPTION

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different FIGURES unless specified otherwise. The structures in the FIGURES are not drawn according to their relative proportions and the drawings should not be interpreted as limiting the disclosure in size, relative size, or location.

The presently disclosed embodiments are generally directed to providing an outermost layer for an imaging member which provides improved cleaning, increased scratch resistance, reduced torque, and reduced ghosting image defects. While conventional overcoat formulations are used to increase mechanical wear and scratch resistance, many of the commonly used overcoat formulations result in high start up and running torque. The present embodiments pertain to an improved outermost layer that has a rough surface morphology which provides improved performance and methods for making the same. In embodiments, the outermost layer can be a charge transport layer or an overcoat layer. In specific embodiments, the outermost layer can be a second charge transport layer having the rough surface morphology disposed over a conventional charge transport layer. The improved formulation includes wax particles which creates the rough surface morphology evenly across the surface of the imaging member or photoreceptor to form the improved overcoat layer.

In the present embodiments, wax particles are incorporated into an overcoat formulation containing a binder, curing agent, and a hole transport material, all dispersed in a solution comprising a solvent or a mixture of solvents. The formulation is subsequently coated onto an imaging member to form an outermost layer which provide improved characteristics.

In embodiments, the solvents may be glycol ether and/or alcohol solvents. The wax particles can be treated or untreated and are incorporated into the formulations to impart a roughened morphology spread evenly over the surface of the resulting outermost layer. In embodiments, the wax particle may be treated with polytetrafluoroethylene (PTFE) to impart enhanced mechanical properties and cleaning efficiency. The morphology of the formed layer improves cleaning performance and scratch resistance, as well reduce torque and ghosting image defects. By controlling the particular sizes of the particles and the coating formulation comprised thereof, the surface morphology can also be controlled to achieve optimal performance of the imaging member.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, the photoreceptor is charged on its surface by means of an electrical charger to which a voltage has been supplied from power supply. The photoreceptor is then imagewise exposed to light from an optical system or an image input apparatus, such as a laser and light emitting diode, to form an electrostatic latent image thereon. Generally, the electrostatic latent image is developed by bringing a developer mixture from developer station into contact therewith. Development can be effected by use of a magnetic brush, powder cloud, or other known development process.

After the toner particles have been deposited on the photoconductive surface, in image configuration, they are transferred to a copy sheet by transfer means, which can be pressure transfer or electrostatic transfer. In embodiments, the developed image can be transferred to an intermediate transfer member and subsequently transferred to a copy sheet.

After the transfer of the developed image is completed, the copy sheet advances to a fusing station, wherein the developed image is fused to the copy sheet by passing copy sheet the between the fusing member and pressure member, thereby forming a permanent image. Fusing may be accomplished by other fusing members such as a fusing belt in pressure contact with a pressure roller, fusing roller in contact with a pressure belt, or other like systems. The photoreceptor, subsequent to transfer, advances to a cleaning station, wherein any toner left on the photoreceptor is cleaned by use of a blade, brush, or other cleaning apparatus.

Electrophotographic imaging members are well known in the art. Electrophotographic imaging members may be prepared by any suitable technique. Referring to the FIGURE, typically, a flexible or rigid substrate 1 may be comprised of a conductive material or may be provided with an electrically conductive surface or coating. The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

Substrate

In embodiments where the substrate layer 1 is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, or from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

Hole Blocking Layer

An optional hole blocking layer 3 may be applied to the substrate 1 or coating. Any suitable and conventional blocking layer capable of forming an electronic barrier to holes between the adjacent photoconductive layer 8 (or electrophotographic imaging layer 8) and the underlying conductive surface of substrate 1 may be used.

Adhesive Layer

An optional adhesive layer may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer 8 is formed on the adhesive layer, blocking layer 3 or substrate 1. The electrophotographic imaging layer 8 may be a single layer that performs both charge-generating and charge transport functions as is well known in the art, or it may comprise multiple layers such as a charge generator layer 5 and charge transport layer 6.

Charge Generation Layer

The charge generating layer 5 can be applied to the electrically conductive surface, or on other surfaces in between the substrate 1 and charge generating layer 5. A charge blocking layer or hole-blocking layer 3 may optionally be applied to the electrically conductive surface prior to the application of a charge generating layer 5. If desired, an adhesive layer may be used between the charge blocking or hole-blocking layer 3 and the charge generating layer 5. Usually, the charge generation layer 5 is applied onto the blocking layer 3 and a charge transport layer 6, is formed on the charge generation layer 5. This structure may have the charge generation layer 5 on top of or below the charge transport layer 6.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration. Other photogenerating materials include titanyl phthalocyanine, or a mixture of alkylhydroxygallium phthalocyanine and hydroxygallium phthalocyanine.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing of the solvent of a solvent coated layer may be effected by any suitable conventional technique such as oven drying, infrared radiation drying, air drying and the like.

Charge Transport Layer

The charge transport layer 6 may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4'-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is a tertiary arylamine selected from the group consisting of N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N,N',N'-tetrakis(4-methylphenyl)-1,1'-biphenyl)-4,4'-diamine, N,N'-bis(4-butylphenyl)-N,N'-di-p-tolyl-[p-terphenyl]-4,4'-diamine, and N,N'-bis(4-butylphenyl)-N,N'-di-m-tolyl-[p-terphenyl]-4,4'-diamine, and the like.

If desired, the charge transport material in the charge transport layer may comprise a polymeric charge transport material or a combination of a small molecule charge transport material and a polymeric charge transport material.

Any suitable electrically inactive resin binder may be employed in the charge transport layer of this invention. Typical inactive resin binders include polycarbonate resin (such as MAKROLON), polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene)carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be used in the charge transporting layer of this invention. The charge transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes there through.

In particular embodiments, the charge transport layer is the outermost layer of the improved imaging member. In such an embodiment, the charge transport layer comprises a polymer matrix, a charge transport component and a plurality of wax particles (as further described below), such that the outermost layer acquires a rough surface morphology. The polymer matrix may comprise a polymer selected from the group consisting of polycarbonate, polyester, polyarylate, polyurethane, polyether, phenol resin, melamine resin, guanamine resin, polysiloxane, and mixtures thereof.

In another embodiment, the outermost layer may be a second charge transport layer disposed on a conventional charge transport layer, where the second charge transport layer comprises the wax particles. The second transport layer may comprise the same charge transport component and the same polymer binder as the conventional transport layer. Alternatively, the second transport layer may comprise different charge transport component and different polymer binder to the conventional transport layer.

The outermost charge transport layer comprising wax particles provides a desired rough surface morphology. Roughness is a measurement of the small-scale variations in the height of a physical surface. In the case of the outermost layer of the imaging member, roughness is beneficial as the texture allows the physical surface to trap lubricants and prevent them from welding together. Roughness measurements may be represented by different standards. For example, average roughness ($R_a$) focuses on the average height of the bumps on a surface and is measured in micrometers or microinches. Root mean square roughness (Rq) gives a value somewhat larger than Ra and varies with surface shape. Rq is also measured in the same units. In the present embodiments, the improved layer formulation provides a charge transport layer having a rough surface morphology that has a Rq of from 0.025 to 5 micrometers, from 0.05 to about 2 micrometers, from 0.05 to about 0.5 micrometers, or from about 0.25 to 0.8 micrometers.

Any suitable and conventional technique may be used to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Overcoat Layer

Traditional overcoat layers comprise a dispersion of nanoparticles, such as silica, metal oxides, PTFE, and the like. The nanoparticles may be used to enhance the lubricity, scratch resistance, and wear resistance of the charge transport layer 6. However, such commonly used overcoat formulations have instability problems and also exhibit higher start up and running torque than control drum photoreceptors without an overcoat layer. In addition, some of these existing overcoat formulations, while exhibiting scratch and wear resistance, also suffer from ghosting and printing defects such as background shading appear in prints.

In embodiments, an overcoated imaging member, comprises an overcoat layer is coated on the charge-transporting layer. As discussed above, the overcoat formulation may incorporate wax particles 10 that provide a roughened surface morphology to the overcoat layer 7. The rough morphology is shown to improve performance of the layer. Imaging members employing the improved overcoat layer exhibit improved cleaning and scratch resistance as well as reduced ghosting and torque.

In such embodiments, the overcoat layer 7 comprises a cured composite composition comprised of polymer resin, a charge transport component and a plurality of wax particles 10, such that the overcoat layer acquires a rough surface morphology. The polymer resin may be selected from the group consisting of melamine-formaldehyde resin, phenol-formaldehyde resin, melamine-phenol-formaldehyde resin, guanamine-formaldehyde resin, and mixtures thereof. In particular embodiments, the polymer resin further comprises a polymer binder selected from the group consisting of an aliphatic polyester polyol, an aromatic polyester polyol, an acrylate polyol, an aliphatic polyether polyol, an aromatic polyether polyol, a (polystyrene-co-polyacrylate) polyol, polyvinylbutyral, poly(2-hydroxyethyl methacrylate), and mixtures thereof.

The wax particles 10 may comprise a polymer wax selected from the group consisting of polyethylene, polypropylene, polyethylene-co-polypropylene, and mixtures thereof. The polyethylene wax particles can be used untreated, such as CRAYVALLAC WS-4700, available from Cray Valley (Puteaux, France), or modified with PTFE, such as CRAYVALLAC WS-1147, also available from Cray Valley. The PTFE modified particles can help enhance dispersion into the overcoat formulation. For example, the polymer wax may be selected from the group consisting of polypolytetrafluoroethylene surface grafted-polyethylene, polytetrafluoroethylene surface grafted polypropylene, and polytetrafluoroethylene surface grafted-polyethylene-co-polypropylene. In specific embodiments, the wax is pre-dispersed and included into the overcoat formulation as, for example, a 40 percent active dispersion of polyethylene wax that may be treated or untreated with PTFE. The wax particles have an average particle size of from about 0.1 micrometer to about 10 micrometers or from about 0.25 micrometer to about 8 micrometers, from about 0.2 micrometer to about 6 micrometers, or from about 0.5 micrometer to about 6 micrometers.

In embodiments, the overcoat layer further comprises a charge transport component. In particular embodiments, the overcoat layer comprises a charge transport component comprised of a tertiary arylamine containing a substituent capable of reacting with the polymer resin to form cured composition. Specific examples of charge transport component suitable for overcoat layer comprise the tertiary arylamine with a general formula of

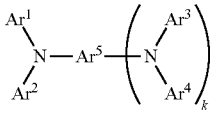

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6 to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

Additional examples of charge transport component which comprise a tertiary arylamine include the following:

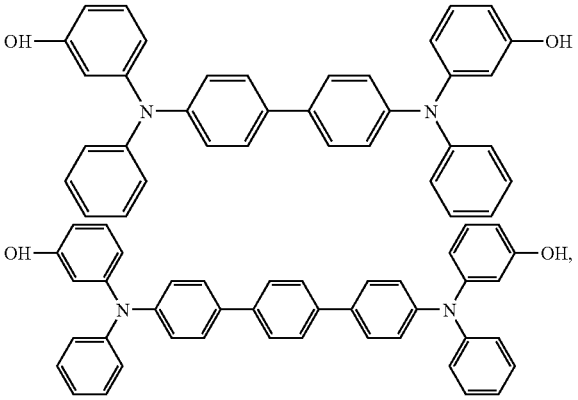

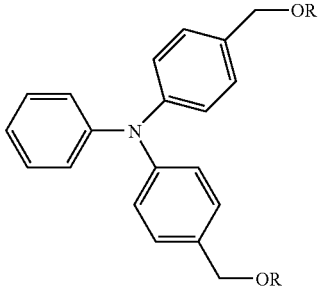

-continued

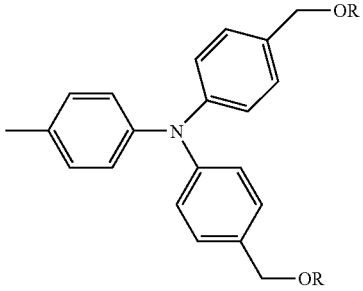

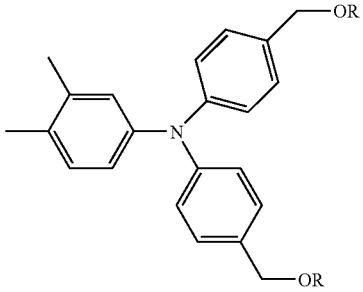

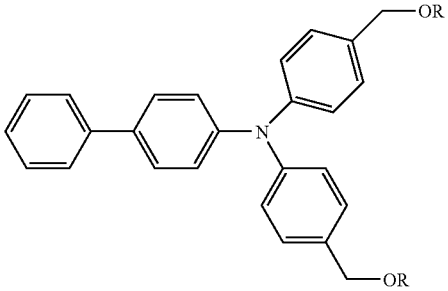

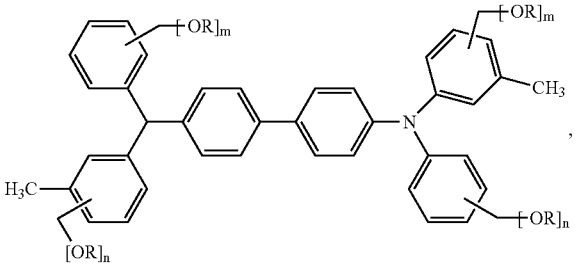

and the like, wherein R is a substituent selected from the group consisting of hydrogen atom, and an alkyl having from 1 to about 6 carbons, and m and n each independently represents 0 or 1, wherein m+n>1.

As discussed above, the formulation provides the overcoat layer with a desired rough surface morphology which provides, for example, increased scratch resistance, reduced ghosting and reduced torque to the layer. In the present embodiments, the improved layer formulation provides the overcoat layer with a rough surface morphology that has a Rq of from 0.025 to 5 micrometers, or particularly from 0.05 to about 2 micrometers.

In embodiments, the wax particles are present in an amount of from 0.5 percent to about 15 percent, or from 1 percent to about 10 percent, of total solids in the overcoat formulation. In a particular embodiment, the wax particles are included at from 3 to about 8 percent of total solids in the overcoat formulation. In embodiments, the charge transport component is present in an amount of from 25 percent to about 90 percent, or from 30 percent to about 60 percent, of total solids in the overcoat formulation.

Any suitable and conventional technique may be utilized to form and thereafter apply the overcoat layer mixture to the imaging layer. Typical application techniques include, for example extrusion coating, draw bar coating, roll coating, wire wound rod coating, and the like. The overcoat layer may be formed in a single coating step or in multiple coating steps. Drying of the deposited coating may be effected by any suitable conventional technique such as oven drying, infra red radiation drying, air drying and the like. The thickness of the dried overcoat layer may depend upon the abrasiveness of the charging, cleaning, development, transfer, etc. system employed and can range up to about 15 microns. In these embodiments, the thickness can be from about 3 microns and about 10 microns in thickness.

In further embodiments, there is provided an electrophotographic imaging apparatus comprising at least one photosensitive member, a charging unit, a developing unit, and a transfer unit. The photosensitive member includes an overcoat layer having a rough surface morphology comprising a cured composite coating, where the coating further comprises a plurality of wax particles, a melamine resin and tertiary arylamine transport component containing a substituent selected from the group consisting of a hydroxyl, a hydroxymethyl, and an alkoxymethyl having from about 2 to about 6 carbons. In embodiments, the photosensitive member may be rigid or flexible.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

EXAMPLE 1

An electrophotographic photoreceptor was fabricated in the following manner. A coating solution for an undercoat layer comprising 100 parts of a ziconium compound (trade name: Orgatics ZC540), 10 parts of a silane compound (trade name: A110, manufactured by Nippon Unicar Co., Ltd), 400 parts of isopropanol solution and 200 parts of butanol was prepared. The coating solution was applied onto a cylindrical aluminum (Al) substrate subjected to honing treatment by dip coating, and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH (Mn=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 25 μm thick charge transport layer (CTL) was dip coated on top of the charge generating layer from a solution of N,N'-diphenyl-N,N'-bis(3-methylphenyl)-1,1'-biphenyl-4,4'-diamine (82.3 parts), 2.1 parts of 2,6-di-tert-butyl-4-methylphenol (BHT) from Aldrich and a polycarbonate, PCZ-400 [poly(4,4'-dihydroxy-diphenyl-1-1-cyclohexane), $M_w$=40,000] available from Mitsubishi Gas Chemical Company, Ltd. (123.5 parts) in a mixture of 546 parts of tetrahydrofuran (THF) and 234 parts of monochlorobenzene. The CTL was dried at 115° C. for 60 minutes.

An overcoat formulation was prepared from a mixture of an acrylic polyol (1.5 parts, JONCRYL-587, available from Johnson Polymers LLC, Sturtevant, Wis., USA), a melamine resin (2.1 parts, CYMEL-303 available from Cytec Industries, Inc. West Paterson, N.J., USA), a charge transport component of N,N'-bis(3-hydroxyphenyl)-N,N'-diphenyl-1,1'-biphenyl-4,4'-diamine (2.42 parts), a polyethylene wax (0.84 parts, WS-4700: 40 wt % wax dispersion in 2-propanol, available from CRAYVALLAC), and an acid catalyst (0.05 part, Nacure 5225 available from King Chemical Industries), in a solvent of 1-methoxy-2-propanol (20.9 parts). The solution was applied onto the photoreceptor surface and more specifically onto the charge transport layer, using cup coating technique, followed by thermal curing at 140° C. for 40 minutes to form an overcoat layer having an average film thickness of about 4 μm. The resulted overcoat resin layer contained about 30 to 35 weight percent of the charge transport component and about 5 weight percent of wax particles. The overcoat possessed rough surface morphology with a root mean square surface roughness (Rq) of about 0.25 micrometers.

EXAMPLE 2

An electrophotographic photoreceptor having an overcoat comprising PTFE-grafted wax particles was fabricated in a similar manner as described in Example 1 except that WS-1147 (PTFE-grafted polyethylene wax dispersion in 2-propanol, available from CRAYVALLAC) was used in place of WS-4700. The overcoat possessed rough surface morphology with a root mean square surface roughness (Rq) of about 0.35 micrometers.

COMPARATIVE EXAMPLE

An electrophotographic photoreceptor having an overcoat comprising no wax particles was fabricated in a similar manner as described in Example 1 except that no wax particles were added in the preparation of overcoat solution.

Evaluation of Electrophotographic Photoreceptor Performance:

The electrical performance characteristics of the above prepared electrophotographic photoreceptors such as electrophotographic sensitivity and short term cycling stability were tested in a scanner. The scanner is known in the industry and equipped with means to rotate the drum while it is electrically charged and discharged. The charge on the photoconductor sample is monitored through use of electrostatic probes placed at precise positions around the circumference of the device. The photoreceptor devices are charged to a negative potential of 500 Volts. As the devices rotate, the initial charging potentials are measured by voltage probe 1. The photoconductor samples are then exposed to monochromatic radiation of known intensity, and the surface potential measured by voltage probes 2 and 3. Finally, the samples are exposed to an erase lamp of appropriate intensity and wavelength and any residual potential is measure by voltage probe 4. The process is repeated under the control of the scanner's computer, and the data is stored in the computer. The PIDC (photo induced discharge curve) is obtained by plotting the potentials at voltage probes 2 and 3 as a function of the light energy. All the photoreceptors as prepared in Examples 1 and 2, showed similar PIDC characteristics as the control or Comparative Example device.

The electrical cycling stability of the photoreceptor was performed using a fixture similar to a xerographic system. The photoreceptor devices (Example 1, Example 2, and the comparative example) with the overcoat showed stable cycling of over 170,000 cycles in a humid environment (28° C., 80% RH).

The electrical testing results of the photoreceptors as measured above indicate that the addition of the was particles has no adverse impact on the electrical characteristics of the photoreceptors.

The torque properties, measured in Newton-meter, of the photoreceptor are measured in the following manner. A photoreceptor was placed in a xerographic customer replaceable unit (CRU), as is used in a DC555 (manufactured by Xerox Corporation. The photoreceptors as fabricated in Example 1 and 2 maintained a low torque of 0.65 and 0.8 Newton·meter, respectively, as compared to the comparative photoreceptor, which displayed a high torque of 1.15 Newton·meter. The results show that the addition of the wax particles in the overcoat reduced torque.

Preliminary print testing with the photoreceptors was conducted in DC555 (manufactured by Xerox Corporation). The photoreceptors as obtained in Example 1 and 2 showed minimal streaking image defects, while the comparative device showed visible streaking image defects with the first 500 prints.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An electrostatographic imaging member comprising:

an electrically conductive substrate;

an imaging layer disposed on the substrate, wherein the imaging layer comprises a charge generation layer disposed on the substrate, and a charge transport layer disposed on the charge generation layer; and an overcoat layer disposed on the charge transport layer, wherein the overcoat layer comprises a cured composite composition comprised of polymer resin, wherein the polymer resin is selected from the group consisting of melamine-formaldehyde resin, phenol-formaldehyde resin, melamine-phenol-formaldehyde resin, guanamine-formaldehyde resin, and mixtures thereof, a charge transport component and a plurality of wax particles, such that the overcoat layer acquires a rough surface morphology; wherein the rough surface morphology has a root mean square surface roughness (Rq) of from about 0.25 to 0.8 micrometers.

2. The electrostatographic imaging member of claim 1, wherein the wax particles comprise a polymer wax selected from the group consisting of polyethylene, polypropylene, polyethylene-co-polypropylene, and mixtures thereof.

3. The electrostatographic imaging member of claim 2, wherein the polymer wax is modified with polytetrafluoroethylene.

4. The electrostatographic imaging member of claim 1, wherein the overcoat layer comprises from 1 to about 10 weight percent of the wax particles.

5. The electrostatographic imaging member of claim 1, wherein the wax particles have an average particle size of from about 0.1 micrometer to about 10 micrometers.

6. The electrostatographic imaging member of claim 5, wherein the wax particles have an average particle size of from about 0.25 micrometer to about 8 micrometers.

7. The electrostatographic imaging member of claim 1, wherein the rough surface morphology has a root mean square surface roughness (Rq) of from about 0.25 to about 0.35 micrometers.

8. The electrostatographic imaging member of claim 1, wherein the overcoat layer further comprises a polymer binder selected from the group consisting of an aliphatic polyester polyol, an aromatic polyester polyol, an acrylate polyol, an aliphatic polyether polyol, an aromatic polyether polyol, a (polystyrene-co-polyacrylate) polyol, polyvinylbutyral, poly(2-hydroxyethyl methacrylate), and mixtures thereof.

9. The electrostatographic imaging member of claim 1, wherein the charge transport component comprises a tertiary arylamine having a general formula of

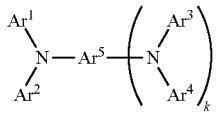

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6 to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxyalkyl having 1 to about 10 carbons, and mixtures thereof.

10. The electrostatographic imaging member of claim 9, wherein $Ar^1$, $Ar^2$, $Ar^3$, and $Ar^4$ each independently represent a phenyl or a substituted phenyl group, and $Ar^5$ represents a biphenyl or a terphenyl group.

11. The electrostatographic imaging member of claim 1, wherein the charge transport component comprises a tertiary arylamine selected from the group consisting of

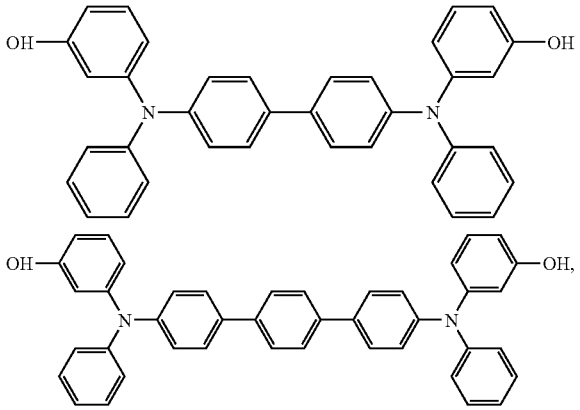

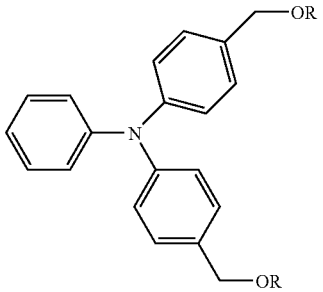

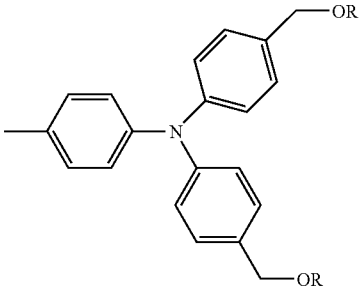

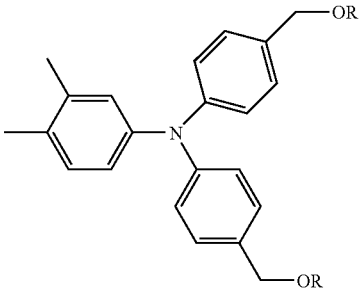

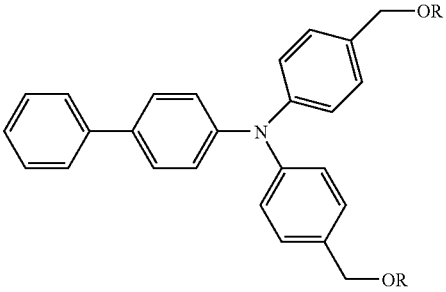

-continued

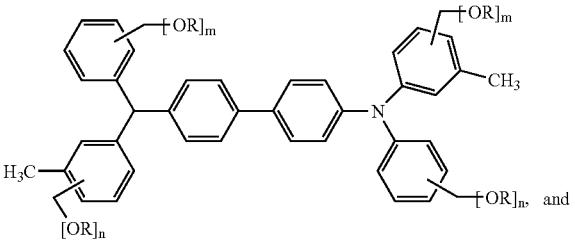

wherein R is a substituent selected from the group consisting of hydrogen atom, and an alkyl having from 1 to about 6 carbons, and m and n each independently represents 0 or 1, wherein m+n>1.

12. The electrostatographic imaging member of claim 1, wherein the charge transport layer comprises a tertiary arylamine selected from the group consisting of N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N,N',N'-tetrakis(4-methylphenyl)-1,1'-biphenyl)-4,4'-diamine, N,N'-bis(4-butylphenyl)-N,N'-di-p-tolyl-[p-terphenyl]-4,4'-diamine, and N,N'-bis(4-butylphenyl)-N,N'-di-m-tolyl-[p-terphenyl]-4,4'-diamine, and wherein the charge generation layer comprises a photosensitive pigment selected from the group consisting of titanyl phthalocyanine, perylene, chlorogallium phthalocyanine, hydroxygallium phthalocyanine, and a mixture of alkylhydroxy gallium phthalocyanine and hydroxygallium phthalocyanine.

13. The electrostatographic imaging member in accordance with claim 1, wherein the charge transport layer comprises hole transport molecules dispersed in a resin binder, the charge generation layer comprises at least one photogenerating pigment dispersed in a resin binder, and the overcoat comprises the cured composite coating comprising the plurality of wax particles, and tertiary arylamine transport component containing a substituent selected from the group consisting of a hydroxyl, a hydroxymethyl, and an alkoxymethyl having from about 2 to about 6 carbons.

14. The electrostatographic imaging member in accordance with claim 13, wherein the wax particles comprise a polymer selected from the group consisting of polyethylene, polypropylene, polyethylene-co-polypropylene, polytetrafluoroethylene surface grafted-polyethylene, polytetrafluoroethylene surface-grafted polypropylene, and polytetrafluoroethylene surface grafted-polyethylene-co-polypropylene, the particles having an average particle size of from about 0.2 micrometer to about 6 micrometers.

15. The electrostatographic imaging member of claim 1, wherein the charge transport layer comprises N,N'-diphenyl-N,N'-bis(3-methylphenyl)-1,1'-biphenyl-4,4'diamine, and the overcoat layer comprises N,N'bis(3-hydroxyphenyl)-N,N'-diphenyl-1,1'-biphenyl-4,4'-diamine.

16. The electrostatographic imaging member of claim 1, wherein the charge generation layer comprises a mixture of alkylhydroxygallium phthalocyanine and hydroxygallium phthalocyanine.

17. An electrophotographic imaging apparatus comprising: at least one photosensitive member comprising an electrically conductive substrate and an imaging layer comprising a photogenerating pigment disposed on the electrically conductive substrate;

a charging unit;

a developing unit; and a transfer unit, wherein the photosensitive member includes an overcoat layer having a rough surface morphology comprising a cured composite coating, the coating further comprising a plurality of wax particles, a melamine resin and tertiary arylamine transport component containing a substituent selected from the group consisting of a hydroxyl, a hydroxymethyl, and an alkoxymethyl having from about 2 to about 6 carbons, and the photosensitive member is rigid or flexible, wherein the overcoat layer acquires a rough surface morphology and the rough surface morphology has a root mean square surface roughness (Rq) of from about 0.25 to 0.8 micrometers.

* * * * *